US006158348A

United States Patent [19]

Campoli

[11] Patent Number: 6,158,348

[45] Date of Patent: Dec. 12, 2000

[54] PROPELLANT CONFIGURATION

[75] Inventor: Ralph L. Campoli, Mine Hill, N.J.

[73] Assignee: Primex Technologies, Inc., Red Lion, Pa.

[21] Appl. No.: 09/211,420

[22] Filed: Dec. 15, 1998

Related U.S. Application Data

[60] Provisional application No. 60/105,071, Oct. 21, 1998.

[51] Int. Cl.[7] ..... F42B 5/16; F42B 5/02

[52] U.S. Cl. ..... 102/443; 102/433; 102/434

[58] Field of Search ..... 102/443, 430, 102/439, 434, 433

[56] References Cited

U.S. PATENT DOCUMENTS

| | | | |
|---|---|---|---|
| 352,125 | 11/1886 | Graydon | 102/443 |
| 372,678 | 11/1887 | Hurst | 102/443 |
| 390,232 | 10/1888 | Hurst | 102/443 |
| 1,194,496 | 8/1916 | Goddard . | |
| 1,920,075 | 7/1933 | Haenichen | 102/443 |
| 2,459,163 | 1/1949 | Hickman | 102/49 |
| 3,648,616 | 3/1972 | Hsu | 102/40 |
| 4,593,622 | 6/1986 | Fibranz | 102/530 |
| 4,674,405 | 6/1987 | Brede et al. | 102/202 |
| 4,823,699 | 4/1989 | Farinacci | 102/443 |
| 4,887,534 | 12/1989 | Dickovich et al. | 102/373 |
| 4,930,421 | 6/1990 | Macdonald | 102/377 |
| 5,007,236 | 4/1991 | Meyers et al. | 60/256 |
| 5,042,388 | 8/1991 | Warren et al. | 102/434 |
| 5,129,324 | 7/1992 | Campoli | 102/430 |
| 5,160,804 | 11/1992 | Wähner et al. | 102/443 |
| 5,180,883 | 1/1993 | Jaskolka et al. | 102/443 |
| 5,289,776 | 3/1994 | Thiesen et al. | 102/431 |
| 5,335,599 | 8/1994 | Thiesen et al. | 102/431 |
| 5,400,715 | 3/1995 | Roach et al. | 102/443 |
| 5,443,009 | 8/1995 | Thiesen et al. | 102/443 |
| 5,557,059 | 9/1996 | Warren et al. | 102/434 |

FOREIGN PATENT DOCUMENTS

| | | | |
|---|---|---|---|
| 69137 | 7/1893 | Germany | 102/443 |
| 198679 | 5/1908 | Germany | 102/443 |

*Primary Examiner*—Michael J. Carone
*Assistant Examiner*—James S. Bergin
*Attorney, Agent, or Firm*—Wiggin & Dana; William B. Slate

[57] ABSTRACT

An ammunition cartridge has a base and a sidewall extending from the base to a mouth. The sidewall bounds an interior of the case. A projectile is secured to the case proximate the mouth and has at least an aft portion within the case interior. A propellant charge is located in a first region of the case interior at least in part surrounding the aft portion of the projectile. A second propellant charge is carried within a second region of the case interior generally aft of the first region.

17 Claims, 2 Drawing Sheets

PROPELLANT CONFIGURATION

CROSS-REFERENCE TO RELATED APPLICATION

Priority is claimed under 35 U.S.C. 119(e) to copending U.S. patent application Ser. No. 60/105,071, filed Oct. 21, 1998.

BACKGROUND OF THE INVENTION

The invention is directed to ammunition in which a portion of the projectile extends substantially aft into the ammunition case. The invention is particularly suitable for use with armor-piercing fin-stabilized discarding sabot (APFSDS) ammunition.

There exists a well-developed art in the field of APFSDS (including, inter alia, APFSDS-T (with tracer)) ammunition. APFSDS rounds have been developed for both rifled barrels (e.g., the 105 mm barrel of the relatively old M60 tank) and smoothbore barrels (e.g., the 120 mm barrel of the relatively new M1A2 tank). A rifled barrel or tube functions to spin-stabilize a projectile encased in the sabot, a principle utilized in a majority of modem weapons from handguns to large naval guns. An exemplary muzzle velocity is from about 1,375 to about 1,650 meters per second. A projectile exiting the muzzle of a rifled tube typically also has a relatively high spin rate. Once the projectile is free of the sabot, it relies on its aerodynamic fins for stability at a relatively low spin rate (e.g., about 70 revolutions per second (rps)). Upon discard of the sabot, the aerodynamic interaction of the projectile's fins with the air angularly accelerates the projectile to ultimately induce a desired low rate of spin (e.g., about 70 rps). With a smoothbore tube, upon discard of the sabot, the aerodynamic interaction of the projectile's fins with the air angularly accelerates the projectile to ultimately induce a desired low rate of spin (e.g., about 70 rps).

BRIEF SUMMARY OF THE INVENTION

The inventor has observed that in conventional APFSDS ammunition cartridges, the propellant charge is ignited via a primer at the base of the cartridge and therefore burns generally from its aft end to its fore end. When conventional propellant (formed in extruded strands) is replaced with economical spheroidal propellant (typically formed as flattened spheres), the inventor has observed damage to the projectiles fired from such ammunition. This has, in particular, been observed in the 25 mm M919 APFSDS-T round. Such globular propellant is disclosed in U.S. Pat. No. 2,027,114, of Fredrich Olsen, the disclosure of which is incorporated herein by reference in its entirety, and is sold under the trademark BALL POWDER by Primex Technologies, Inc. of St. Marks, Fla. The inventor believes that compaction of the propellant near the fore end of the case (by the initial combustion of the propellant at the aft end) leaves an annulus of propellant forward of the projectile fins yet unburned when the combustion of propellant aft of the projectile drives the projectile forward. The fins therefore collide with this annulus of compacted unburned propellant and are damaged, degrading projectile performance.

Accordingly, in one aspect, the invention is directed to an ammunition cartridge. The cartridge has a case having a base and a sidewall extending from the base to a mouth. The sidewall bounds an interior of the case. A projectile is secured to the case proximate the mouth and has at least an aft portion within the case interior. A propellant charge is located in a first region of the case interior at least in part surrounding the aft portion of the projectile. A second propellant charge is carried within a second region of the case interior generally aft of the first region. The second propellant charge has a burn rate slower than a burn rate of the first propellant charge.

The cartridge may include a combustible containment tube containing the first propellant charge and separating the first propellant charge from the second propellant charge. The cartridge may include a flash tube having an aft end proximate the base of the case and a fore end coupled to an aft end of the containment tube. The projectile may include a body having a nose and a tail. The projectile may further include a plurality of stabilizing fins projecting from the body. The cartridge may further include a discardable sabot. The sabot may have an engagement portion for surrounding the projectile and engaging the projectile to prevent relative longitudinal movement of the projectile and sabot. The sabot may have a bourrelet portion extending outward from the engagement portion and engaged with the case to secure the sabot and projectile to the case. The containment tube may have a fore end affixed to the sabot. The first region may be at least in part forward of the stabilizing fins. The flash tube may be substantially non-combustible.

The containment tube may include a straight aft tubular boss portion for receiving the fore end of the flash tube. The containment tube may further include a straight mediate tubular portion surrounding the stabilizing fins and a flange portion coupling the aft tubular portion to the mediate tubular portion. A fore tubular portion may couple the mediate tubular portion to the sabot. The fore tubular portion may have a general aft-to-fore taper. The containment tube may be adhered to the bourrelet portion.

The cartridge may further include a percussion primer having a primer charge and mounted in a primer pocket of the base. The primer pocket may be aligned with and coupled to the aft end of the flash tube so that ignition of the primer charge ignites a flash tube charge, which in turn ignites the first propellant charge. The second propellant charge may constitute the majority of total propellant within the case. The first propellant charge may be substantially laterally surrounded by a fore portion of the second propellant charge. The first propellant charge may be predominantly formed of a first spheroidal propellant and the second charge may be predominantly formed of a second spheroidal propellant.

In another aspect, the invention is directed to a method for manufacturing a fin-stabilized discarding-sabot ammunition cartridge. The method includes providing a saboted projectile. The saboted projectile includes a subcaliber penetrator having an elongate body and a plurality of stabilizing fins projecting from the body. The discardable sabot comprises an engagement portion for surrounding the penetrator and engaging the penetrator to prevent relative longitudinal movement. The sabot further includes a bourrelet portion extending outward from the engagement portion. A container is provided, sized to surround a portion of the penetrator aft of the bourrelet. A first propellant is introduced into the container. A case is provided extending from a mouth to a base. A second propellant charge is introduced into the case. An aft portion of the saboted projectile is inserted through the mouth and into the case. The aft portion is surrounded by the container and the first propellant charge. The case is secured to the bourrelet.

The securing step may include crimping the case to the bourrelet. The container may be provided as a combustible containment tube for containing the first propellant charge. A fore end of the containment tube may be secured to the sabot such as via an adhesive. The insertion of the aft portion of the saboted projectile through the mouth and into the case may cause a fore end of the flash tube to rupture a membrane sealing the containment tube proximate an aft end of the containment tube. The first propellant charge may be provided having a first burn rate and the second propellant charge may be provided having a second burn rate which is lower than the first burn rate. The second propellant charge may consist essentially of a spheroidal propellant.

In another aspect, the invention is directed to an improvement in an ammunition cartridge of the type having a projectile with an aft portion of the projectile extending into a cartridge case. The improvement includes a propellant and a propellant ignition system configured so that the ignition system initiates combustion of a fore portion of the propellant prior to combustion of a major portion of the propellant. The fore portion of the propellant initially blocks exit of the aft portion of the projectile from a mouth of the case. The fore portion combusts by a time at which the combustion of the major portion drives the aft portion of the projectile through a space initially occupied by the fore portion of the propellant.

Other aspects of the present invention will be readily apparent upon reading the following detailed description of the invention, and from the drawing and the claims.

BRIEF DESCRIPTION OF THE DRAWINGS

Like reference numbers and designations in the several views indicate like elements.

DETAILED DESCRIPTION OF THE INVENTION

Figure 1:
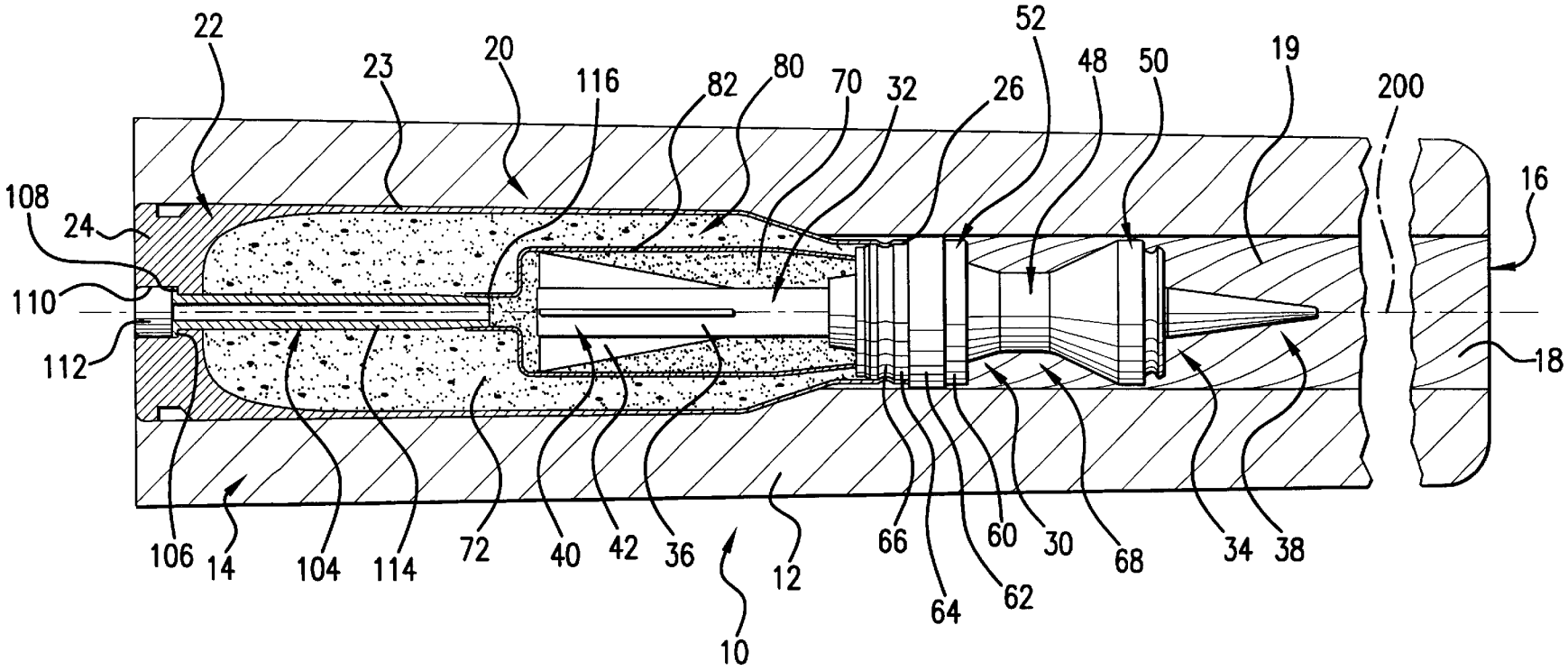
FIG. 1 is a partial cut away longitudinal cross-sectional view of an ammunition round according to principles of the invention chambered in a weapon.

FIG. 1 shows a weapon 10 having a tube 12 extending from a chamber 14 at the aft end of the tube to a muzzle 16 formed by a fore end of the tube. The tube extends along a central longitudinal axis 200 and has a rifled bore or inner surface 18 with a groove-to-groove diameter and a land-to-land diameter, which in the exemplary embodiment are dimensioned to accommodate and fire M919 ammunition. As shown in FIG. 1, the rifling 19 has a right hand twist as is common for weapons of U.S. manufacture although the invention is equally amenable to use with left hand twist and smoothbore tubes.

Figure 2:
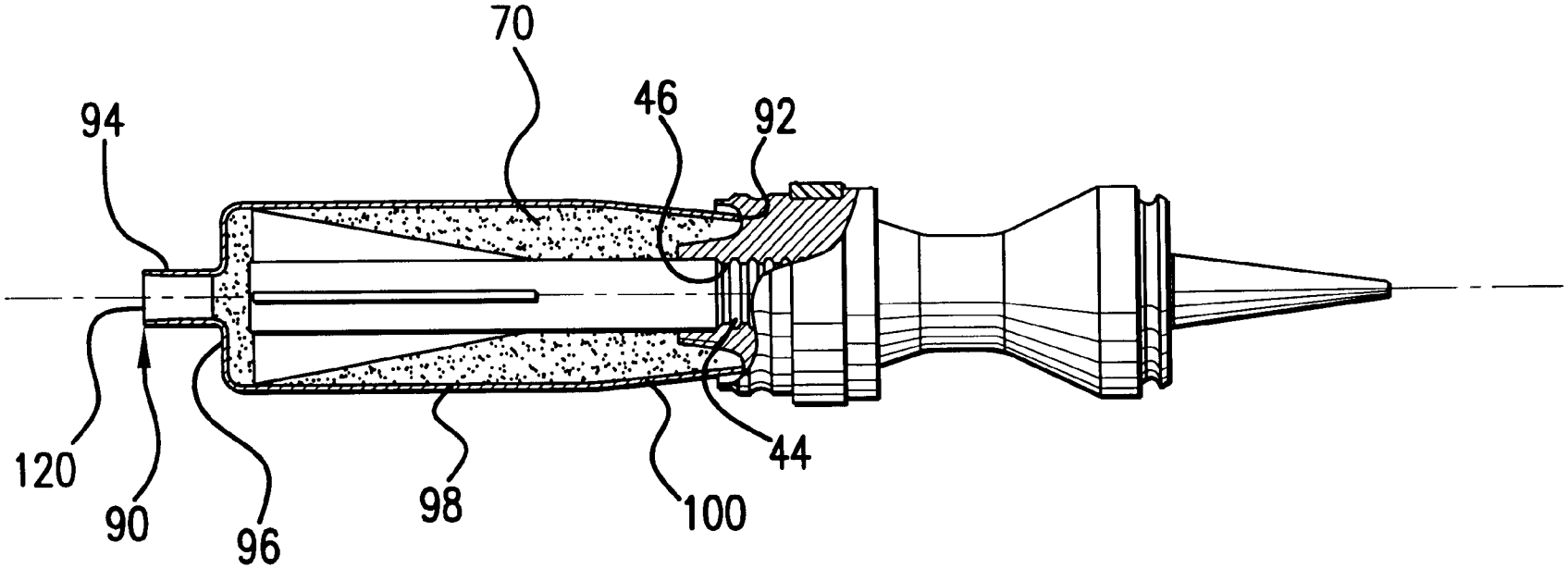
FIG. 2 is a partial cutaway longitudinal cross-sectional view of a saboted projectile including a first propellant charge according to principles of the invention.

An ammunition round 20 is provided having a steel case 22 accommodated within the chamber 14. The case has a sidewall 23 extending from a base 24 to a mouth 26 and has an interior which may be filled with propellant as described below. A saboted projectile 30 is accommodated within the mouth 26 of the case 22, an aft portion 32 extending into the case 22 and a fore portion 34 extending into the tube 12. The projectile, shown as a long rod penetrator, includes a body 36 formed primarily of a high-density metal such as tungsten and/or depleted uranium. The body 36 extends from a nose 38 (formed as an aerodynamic ballistic tip) to a tail 40 and bears a plurality of (for example, four) fins 42 extending generally radially outward proximate the tail 40. Centrally along the body, the penetrator bears interlocking features 44 (FIG. 2) engageable with mating interlocking features 46 of the sabot 48. The interlocking features may be formed as screw-like threads or as annular thread-like grooves/protrusions engaged with each other so as to be effective to prevent relative longitudinal movement of the penetrator and sabot body.

The sabot is substantially formed in two segments or petals which, when assembled, define a sabot body. The petals are identical to each other which facilitates a balanced sabot and smooth discard of the sabot. The petals are separated from each other along a planar interface. The assembled sabot fully encircles a major portion of the penetrator body. Referring back to FIG. 1, the sabot body includes fore and aft protuberances 50 and 52 dimensioned to cooperate with the bore 18 so as to maintain the projectile substantially centered along the axis 200. In the exemplary embodiment, the petals, and thus the sabot body, are primarily formed of aluminum or another light weight metal. A composite material may alternatively be used. Suitable composite materials include: carbon and/or aramid fiber in an epoxy or other resinous matrix.

The fore protuberance 50 is formed as an annular scoop. Along the forward-facing rim of the scoop, an annular frangible band (not shown) is secured. At the fore protuberance, the sabot has an external diameter, which, in the exemplary embodiment, is slightly under 1 in (2.54 cm), e.g. approximately 0.95 in (2.4 cm).

The aft protuberance 52 is longitudinally broader than the fore protuberance or scoop 50, forming a bulkhead which largely retains propellant gases behind it and provides the principal positioning of the saboted projectile along the axis 200. The aft protuberance or bulkhead 52 serves as a bourrelet to guide the projectile as it travels the length of the tube. The sabot body includes a saddle area between protuberances and tapers from the fore protuberance to the aft end of the sabot. The bulkhead 52 has a forward cylindrical surface portion 60 having an external diameter which is approximately equal to the land-to-land diameter (e.g., about 0.97 in (2.5 cm) in the exemplary embodiment). In the exemplary embodiment, the forward cylindrical surface 60 extends approximately 0.15 in (0.4 cm). An annular compliant obturator 62 about a sealing band (not shown) is carried by a channel aft of the surface 60 along the bulkhead. An aft surface 64, aft of the obturator, is of similar overall diameter and length to the front surface 60 and bears an annular crimping groove 66 to which the case 22 may be crimped about its mouth. At the aft end of sabot, a frangible annular band (not shown) further secures the petals in their assembled condition. With the round chambered in the weapon, an annular saddle space 68 is defined along the saddle between the fore and aft protuberances. The saddle and saddle space are so named due to the saddle-like sectional profile of the sabot body between the protuberances.

Contained within the case interior are first and second propellant charges 70 and 72, respectively. The first propellant charge 70 is located in a first region of the case interior at least in part surrounding the aft portion of the projectile. In the illustrated embodiment, the first propellant charge substantially entirely surrounds that portion of the projectile aft of the aft protuberance or sabot bulkhead. The second propellant charge 72 is carried within a second region of the case interior generally aft of the first region. In the illustrated embodiment, the second propellant charge has a burn rate slower than a burn rate of the first propellant charge. By way of example, the first propellant charge 70 may be a fine grain propellant while the second propellant charge 72 may be regular grain propellant having a larger typical grain size than the fine grain propellant. In the illustrated embodiment, the first region is at least in part forward of the stabilizing fins 42 and a fore portion 80 of the second propellant charge substantially surrounds the first propellant charge. By way of example, the second propellant charge 72 may consist essentially of BALL POWDER propellant having a characteristic web thickness of 0.026 in (0.066 cm) having average linear burn rates of 7.5 in/s (19 cm/s) at 50,000 psi (345 MPa) and 1.1 in/s (2.8 cm/s) at 5,000 psi (34.5 MPa). The first propellant charge 70 may then consist essentially of BALL POWDER propellant having a characteristic web thickness of 0.019 in (0.048 cm) and average linear burn rates of 11.2 in/s (28.5 cm/s) and 1.5 in/s (3.8 cm/s) at 50,000 psi (345 MPa) and 5,000 psi (34.5 MPa), respectively. Advantageously, the average linear burn rate of the propellant in the first propellant charge 70 may be at least 1.2 times that of the propellant in the second propellant charge 72 over a range of pressures from about 5,000 psi (34.5 MPa) to about 50,000 psi (345 MPa). Such ratio of burn rates may advantageously be in a range of from about 1.2:1 to about 2.0:1 over such pressure range; more preferably, from about 1.35:1 to about 1.50:1. Advantageous ranges of a web thickness ratio of the propellant in the second propellant charge relative to that in the first propellant charge may be from about 1.2:1 to about 1.8:1, however this may be less significant than the result achieved in terms of burn rates.

A container 82 in the form of a combustible containment tube contains the first propellant charge 70 and separates the first propellant charge from the second propellant charge 72. The containment tube is formed of a thin combustible material such as nitrocellulose paper having an aft end 90 and fore end 92. From aft-to-fore, the containment tube includes a straight aft tubular boss portion 94 which, at its own fore end, diverges to form a flat annular flange portion 96. The flange portion 96 extends from a central aperture at the boss to a circular perimeter at the aft end of a straight mediate tubular portion 98 which surrounds the fins 42. A fore tubular portion 100 extends forward from the fore end of the mediate tubular portion 98 and couples the mediate portion to the sabot at the containment tube's fore end 92. In the exemplary embodiment, the boss 94 has an internal diameter of 0.25 in (0.64 cm) and a length of 0.36 in (0.9 cm), the mediate tubular portion 98 has an internal diameter of about 0.89 in (2.3 cm) and a length of about 1.62 in (4.1 cm), and the fore tubular portion 100 has a general aft-to-fore taper of about seven degrees and a length of about 0.75 in (1.9 cm), thus having at its fore end a diameter of about 0.69 in (1.75 cm). In the exemplary embodiment, the diameter of the mediate portion is chosen to closely accommodate the fins 42. The flange portion 96 is positioned slightly behind the aft end of the projectile (e.g., by about 0.28 in (0.7 cm)). The first propellant charge substantially fills the space within the containment tube around the projectile from the sabot to the flange portion 96.

The containment tube is dimensioned and sized to mate with a flash tube 104. The flash tube 104 includes an annular flange 106 abutting the base 108 of a cylindrical primer pocket 110 formed in the case base 24. The flash tube is preferably imperforate, having openings only at its ends. A cup-type percussion primer 112 is accommodated in the primer pocket 110 by press fit. The flash tube includes an elongate tubular body 114 extending forward from the flange 106 to a fore end 116. The body 114 tapers slightly toward the fore end 116 with the tapered portion being received and accommodated within an aft portion of the boss 94. In the exemplary embodiment, the flash tube has a length of about 1.7 in (4.3 cm) and outer and inner diameters of about 0.2 in (0.5 cm) and about 0.1 in (0.25 cm) along the major portion of its length.

To assemble the cartridge 20, the sabot may first be applied to the projectile. The containment tube is then assembled to the saboted projectile by adhering the fore end of the tube to the bulkhead 52. In the illustrated embodiment, the fore end of the tube is adhered to a concave, approximately semitoroidal aft-facing surface of the bulkhead 52. The first propellant charge is then introduced into the containment tube through the boss. The boss is then sealed such as by cementing a thin piece of onion skin paper 120 over the aft end 90 of the containment tube.

The flash tube 104 which, in the illustrated embodiment, is formed of a noncombustible material such as steel or another metal, is sealed at its fore end such as by cementing a thin onion skin paper over the fore end of the tube. The flash tube is at least partially filled with a flash charge of flash powder. The flash tube is then inserted through a cylindrical hole between the primer pocket 110 and the case interior. Once inserted, the primer 112 is inserted and press fit into the pocket 110 and bears against the flange 106 to securely hold the flash tube in place.

The second propellant charge is then introduced into the case through the case mouth. The onion skin paper over the fore end of the flash tube prevents the second propellant charge from entering the flash tube. The aft portion of the saboted projectile surrounded by the containment tube and first propellant charge is then inserted through the case mouth 26 and into the case. When the exterior surface of the containment tube initially comes into contact with the second propellant charge, the containment tube may be gently rotated in a reciprocal fashion or otherwise manipulated by the assembler to ease its immersion into the second propellant charge, allowing the second propellant charge to surround the first propellant charge. During such insertion, the fore end of the flash tube comes into contact with the onion skin paper membrane 120 sealing the containment tube. Further insertion causes the fore end of the flash tube to rupture the membrane 120 thereby improving communication from the flash tube to the first propellant charge. When the insertion is complete so that the case mouth surrounds the bulkhead, the case is crimped to the bulkhead about the crimping groove 66 to secure the saboted projectile to the case.

In use, the round is chambered in the associated weapon and the primer 112 is actuated to ignite the primer charge. Ignition of the primer charge causes the flash charge to ignite with ignition migrating from the aft end of the flash tube to the fore end of the flash tube. When the combustion reaches the fore end of the flash tube, it then enters the containment tube, causing rapid ignition of the first propellant charge 70. Ignition of the first propellant charge increases the pressure within the case, producing a pressure on the aft surface of the bulkhead which tends to drive the saboted projectile longitudinally down the bore of the weapon overcoming engagement of the crimped case and bulkhead. The ignition of the first propellant charge causes combustion of the containment tube and initiates ignition of the second propellant charge. Ignition of the second propellant charge further increases pressure within the case and further accelerates the saboted projectile down the tube.

The first propellant charge had initially represented a fore portion of the total propellant charge blocking exit of the fins 42 from the mouth of the case. Its prior ignition clears the space it initially occupied. Combustion of the major portion of the total propellant, represented by the second propellant charge, is thus free to drive the saboted projectile so that the fins 42 pass through the vacated space without damage.

Although one or more embodiments of the present invention have been described, it will nevertheless be understood that various modifications may be made without departing from the spirit and scope of the invention. For example, although applied to a particular configuration of push-type sabot, the principles of the invention may be applied to other push-type sabots and to other type of sabots including pull-type sabots wherein the obturator is located in a relatively forward location (e.g., on the forward protuberance or flange). Although shown applied to a APFSDS round, principles of the invention may be applied to non-saboted rounds, including a variety of fin-stabilized explosive rounds and other rounds wherein any portion of the projectile extends within the case at least partially aft of some portion of the propellant contained within the case. Although shown as a one-piece steel case, the case may be otherwise formed, such as by the combination of a steel base and a combustible sidewall.

Accordingly, other embodiments are within the scope of the following claims.

What is claimed is:

1. An ammunition cartridge comprising:

a case having a base and a sidewall extending from the base to a mouth and bounding an interior;

a projectile secured to the case proximate the mouth of the case and having at least an aft portion within the case interior;

a first propellant charge located in a first region of the case interior at least in part surrounding the aft portion of the projectile; and a second propellant charge carried within a second region of the case interior generally aft of the first region and having a burn rate slower than a burn rate of the first propellant charge, wherein the first propellant charge is substantially laterally surrounded by a fore portion of the second propellant charge.

2. The ammunition cartridge of claim 1, further comprising:

a combustible containment tube for containing the first propellant charge and separating the first propellant charge from the second propellant charge.

3. The ammunition cartridge of claim 1, wherein the second propellant charge constitutes the majority of total propellant within the case.

4. The ammunition cartridge of claim 1, wherein the first propellant charge is predominately formed of a first spheroidal propellant having a first average linear burn rate at 50,000 psi (345 MPa) and the second propellant charge is predominately formed of a second spheroidal propellant having a second average linear burn rate at 50,000 psi (345 MPa) such first average linear burn rate being between about 1.2 and 2.0 times the second average linear burn rate.

5. The ammunition cartridge of claim 1, wherein the first propellant charge has a first characteristic grain size and the second propellant charge has a second characteristic grain size greater than the first characteristic grain size.

6. An ammunition cartridge comprising:

a case having a base and a sidewall extending from the base to a mouth and bounding an interior;

a projectile secured to the case proximate the mouth of the case and having at least an aft portion within the case interior;

a first propellant charge located in a first region of the case interior at least in part surrounding the aft portion of the projectile;

a second propellant charge carried within a second region of the case interior generally aft of the first region and having a burn rate slower than a burn rate of the first propellant charge;

a combustible containment tube for containing the first propellant charge and separating the first propellant charge from the second propellant charge; and a flash tube, having an aft end proximate the base of the case and a fore end coupled to an aft end of the combustible containment tube.

7. The ammunition cartridge of claim 5, wherein the projectile includes:

a body having a nose and a tail; and a plurality of stabilizing fins projecting from the body; wherein the cartridge further comprises:

a discardable sabot comprising:

an engagement portion for surrounding the projectile and engaging the projectile to prevent relative longitudinal movement of the projectile and sabot; and a bourrelet portion extending outward from the engagement portion and engaged with the case to secure the sabot and projectile to the case.

8. The ammunition cartridge of claim 7, wherein the containment tube has a fore end affixed to the sabot.

9. The ammunition cartridge of claim 7, wherein the first region is at least in part forward of the stabilizing fins.

10. The ammunition cartridge of claim 9, wherein the flash tube is substantially noncombustible and wherein the containment tube comprises:

a straight aft tubular boss portion for receiving the fore end of the flash tube;

a straight mediate tubular portion surrounding the stabilizing fins;

a flange portion coupling the aft tubular portion to the mediate tubular portion; and a fore tubular portion coupling the mediate tubular portion to the sabot.

11. The ammunition cartridge of claim 10, wherein the fore tubular portion has a general aft-to-fore taper.

12. The ammunition cartridge of claim 7, wherein the containment tube is adhered to the bourrelet portion.

13. The ammunition cartridge of claim 6, further comprising:

a percussion primer having a primer charge and mounted in a primer pocket of the base, the primer pocket aligned with and coupled to the aft end of the flash tube so that ignition of the primer charge ignites a flash tube charge, which in turn ignites the first propellant charge.

14. The ammunition cartridge of claim 6, wherein the first propellant charge is substantially laterally surrounded by a fore portion of the second propellant charge.

15. The ammunition cartridge of claim 6, wherein the second propellant charge constitutes the majority of total propellant within the case.

16. The ammunition cartridge of claim 6, wherein the first propellant charge is predominately formed of a first spheroidal propellant having a first average linear burn rate at 50,000 psi (345 MPa) and the second propellant charge is predominately formed of a second spheroidal propellant having a second average linear burn rate at 50,000 psi (345 MPa) such first average linear burn rate being between about 1.2 and 2.0 times the second average linear burn rate.

17. The ammunition cartridge of claim 6, wherein the first propellant charge has a first characteristic grain size and the second propellant charge has a second characteristic grain size greater than the first characteristic grain size.

* * * * *